US009187970B2

(12) United States Patent
Coles et al.

(10) Patent No.: US 9,187,970 B2
(45) Date of Patent: Nov. 17, 2015

(54) WELLBORE ISOLATION DEVICES AND METHODS OF USE TO PREVENT PUMP OFFS

(71) Applicant: Halliburton Energy Services, Inc., Houston, TX (US)

(72) Inventors: Randolph S. Coles, Spring, TX (US); Christian S. Mappus, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 65 days.

(21) Appl. No.: 14/357,655

(22) PCT Filed: Jul. 25, 2013

(86) PCT No.: PCT/US2013/051999
§ 371 (c)(1),
(2) Date: May 12, 2014

(87) PCT Pub. No.: WO2015/012834
PCT Pub. Date: Jan. 29, 2015

(65) Prior Publication Data

US 2015/0275624 A1 Oct. 1, 2015

(51) Int. Cl.
*E21B 23/10* (2006.01)
*E21B 34/14* (2006.01)

(52) U.S. Cl.
CPC ..... *E21B 23/10* (2013.01); *E21B 34/14* (2013.01)

(58) Field of Classification Search
CPC ..... E21B 34/06; E21B 34/101; E21B 34/10; E21B 34/12; E21B 34/125; E21B 34/14; E21B 23/08; E21B 23/10; E21B 23/06; E21B 17/07; E21B 33/124; E21B 33/12; E21B 33/128; E21B 33/14; E21B 33/16; E21B 33/134
See application file for complete search history.

(56) References Cited

U.S. PATENT DOCUMENTS 4,181,344 A * 1/1980 Gazda ..... E21B 23/00 166/125
4,361,195 A 11/1982 Evans
(Continued)

FOREIGN PATENT DOCUMENTS

WO 2015012834 A1 1/2015

OTHER PUBLICATIONS

International Search Report and Written Opinion for PCT/US2013/051999 dated Apr. 11, 2014.

*Primary Examiner* — Blake Michener
*Assistant Examiner* — David Carroll
(74) *Attorney, Agent, or Firm* — McDermott Will & Emery LLP; Scott H. Brown

(57) ABSTRACT

Disclosed is a downhole tool that includes a housing coupled to a wellbore isolation device, a tension-actuated valve arranged within the housing and having a first piston movably arranged within a first piston chamber, the first piston being coupled to a conveyance such that tension in the conveyance is transmitted to the first piston, wherein, when the tension in the conveyance is reduced, the first piston is moved within the first piston chamber such that wellbore fluids are able to enter the first piston chamber, and a pressure-actuated valve arranged within the housing and having a second piston movably arranged within a second piston chamber to place the second piston chamber in fluid communication with the first piston chamber, wherein a pressure drop across the downhole tool allows the second piston to move such that the wellbore fluids pass into the second piston chamber and through the wellbore isolation device.

19 Claims, 3 Drawing Sheets

(56) References Cited

U.S. PATENT DOCUMENTS

| | | | |
|---|---|---|---|
| 6,035,880 | A | 3/2000 | Gazda |
| 6,145,598 | A | 11/2000 | Carisella |
| 6,182,775 | B1 | 2/2001 | Hipp |
| 6,394,180 | B1 | 5/2002 | Berscheidt et al. |
| 7,740,079 | B2 | 6/2010 | Clayton et al. |
| 2009/0095466 | A1 | 4/2009 | Obrejanu |

* cited by examiner

WELLBORE ISOLATION DEVICES AND METHODS OF USE TO PREVENT PUMP OFFS

This application is a National Stage entry of and claims priority to International Application No. PCT/US2013/051999, filed on Jul. 25, 2013.

BACKGROUND

The present disclosure generally relates to downhole tools for use in oil and gas wellbores and, more particularly, to the downhole transport and setting of wellbore isolation devices such as downhole bridge plugs and frac plugs.

In the drilling, completion, and stimulation of hydrocarbon-producing wells, a variety of downhole tools are used. For example, it is often desirable to seal portions of a casing string extended within the wellbore, such as during fracturing operations when various fluids and slurries are pumped from the surface into the casing string and forced out into a surrounding subterranean formation. It thus becomes necessary to seal the casing and thereby provide zonal isolation. Wellbore isolation devices, such as packers and bridge plugs, are designed for these general purposes and are well known in the art of producing hydrocarbons, such as oil and gas.

Another type of wellbore isolation device is a fracturing plug or "frac" plug, which is essentially a downhole packer with a ball seat for receiving a frac ball. When the frac plug is set and the frac ball engages the ball seat, the casing string or other tubing in which the frac plug is set is effectively sealed and fluids flowing from the surface are thereby prevented from bypassing the frac plug. At this point, a "fracking" fluid or slurry can be pumped into the well and is thereby forced into the surrounding subterranean formation above the frac plug.

Frac plugs are typically attached to a conveyance at the surface and pumped to a target zone within the well using hydraulic pressure applied from the surface. Pump down operations in horizontal wells, however, are often frustrated when there is sand, wellbore debris, or other downhole obstructions built up or otherwise disposed within the well or casing string. When the frac plug reaches such downhole obstructions it tends to either slow down or come to a complete stop altogether.

Slowing or stopping the frac plug results in the build up of hydraulic pressure behind the frac plug within the casing string. In some cases, the increased hydraulic pressure forces or impels the frac plug through the downhole obstruction. In such cases, the full force of the surface pump is assumed by the conveyance which can result in the frac plug or other attendant downhole tools being severed from or "pumped off" the conveyance. It would be advantageous to have a device or system capable of automatically relieving downward hydraulic pressure on the frac plug under such conditions, and thereby prevent unwanted frac plug pump offs.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure generally relates to downhole tools for use in oil and gas wellbores and, more particularly, to wellbore isolation devices such as downhole bridge plugs and frac plugs.

The embodiments discussed and described herein help reduce hydraulic forces that may act on a downhole tool after experiencing a rapid pressure drop during pump down operations. In particular, the exemplary downhole tool described herein includes a tension-actuated valve and a pressure-actuated valve used in conjunction with one or more wellbore isolation devices, such as a frac plug, a bridge plug, or a wellbore packer. The valves may be configured to automatically relieve excessive pressure on the downhole tool by allowing wellbore fluids to flow through the downhole tool in reaction to the rapid pressure drop experienced across the downhole tool. This will enable safer and more reliable operations by reducing the risk of separation of the downhole tool from the conveyance that delivers the downhole tool into the wellbore. This will also mitigate damages and expenses that would otherwise incur from expensive fishing operations designed to retrieve a downhole tool that has separated from the conveyance.

Figure 1:
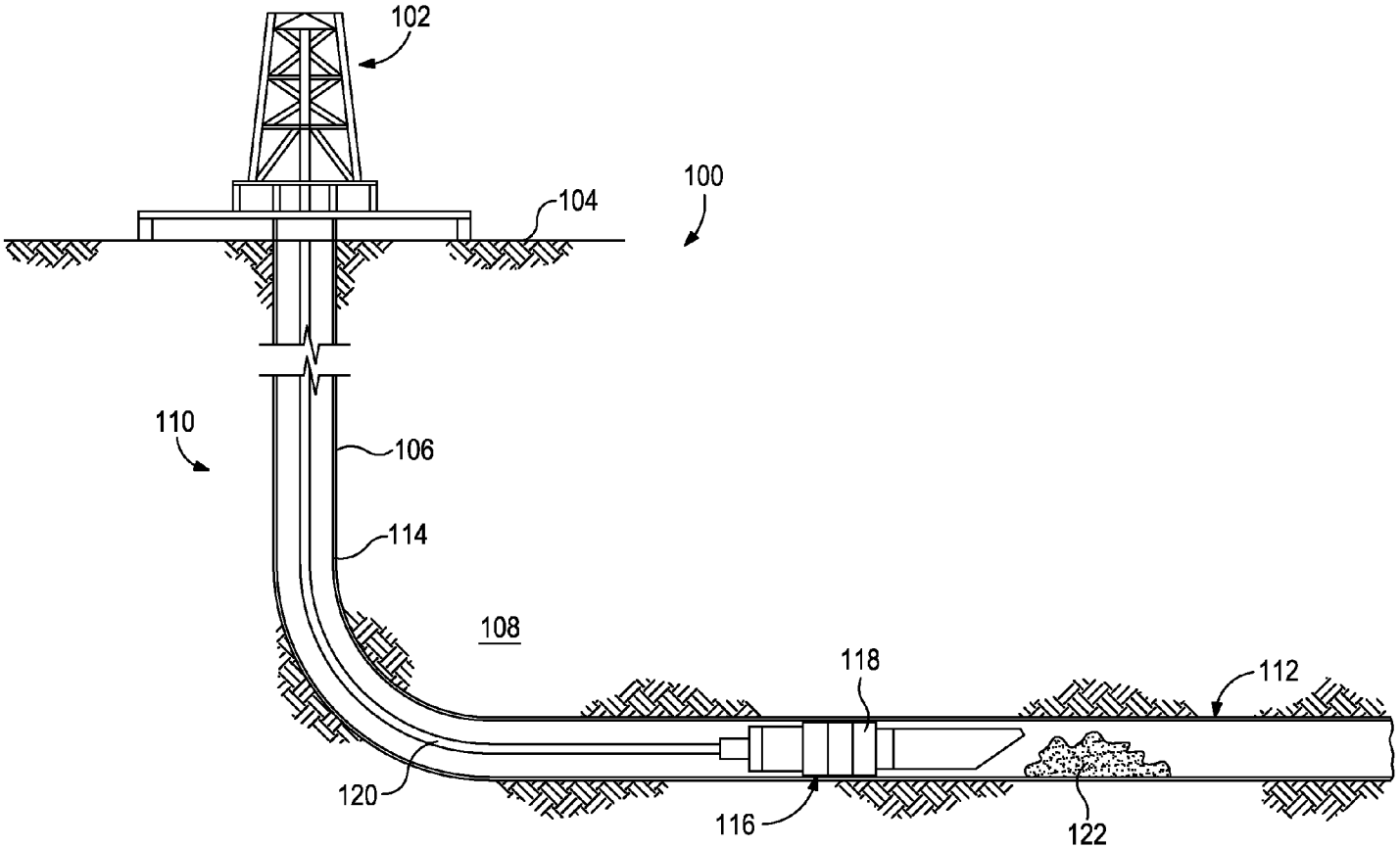
FIG. 1 is a well system that employs one or more principles of the present disclosure, according to one or more embodiments.

Referring to FIG. 1, illustrated is a well system 100 that may embody or otherwise employ one or more principles of the present disclosure, according to one or more embodiments. As illustrated, the well system 100 may include a service rig 102 that is positioned on the earth's surface 104 and extends over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation, without departing from the scope of the disclosure. While the well system 100 is depicted as a land-based operation, it will be appreciated that the principles of the present disclosure could equally be applied in any sea-based or sub-sea application where the service rig 102 may be a floating platform or sub-surface wellhead installation, as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the earth's surface 104 and transition into a substantially horizontal wellbore portion 112. In some embodiments, the wellbore 106 may be completed by cementing a casing string 114 within the wellbore 106 along all or a portion thereof.

The system 100 may further include a downhole tool 116 conveyed into the wellbore 106. The downhole tool 116 may include one or more wellbore isolation devices 118, such as a frac plug, a bridge plug, a wellbore packer, or any other casing or borehole isolation device known to those skilled in the art.

While the wellbore isolation device 118 described herein may be generally characterized or described as a frac plug, those skilled in the art will readily recognize that the principles of the disclosure may equally be applied to other casing or borehole isolation devices, such as bridge plugs and wellbore packers, without departing from the scope of the disclosure.

As illustrated, the downhole tool 116 may be coupled or otherwise attached to a conveyance 120 that extends from the service rig 102. The conveyance 120 may be, but is not limited to, a wireline, a slickline, an electric line, coiled tubing, or the like. In operation, the downhole tool 116 as coupled to the conveyance 120 may be pumped downhole to a target location (not shown) within the wellbore 106 using hydraulic pressure applied from the service rig 102 at the surface 104. Accordingly, portions of the downhole tool 116 may at least partially seal against the inner walls of the casing string 114 to thereby generate a pressure differential across the downhole tool 116 that is used to propel it downhole. The conveyance 120 serves to maintain control of the downhole tool 116 as it traverses the wellbore 106 and provides the necessary power to actuate and set the wellbore isolation device 118 upon reaching the target location.

As is often the case, the downhole tool 116 may encounter one or more downhole obstructions 122 while being conveyed to the target location. This may be especially true in the horizontal portion 112 of the wellbore 106. The downhole obstruction 122 may be sand, wellbore debris, or any other obstruction that may impede the downhole progress of the downhole tool 116 within the casing string 114. Upon reaching the downhole obstruction 122, the downhole tool 116 may either slow down or come to a stop altogether. As a result, hydraulic pressure uphole (i.e., behind) from the downhole tool 116 will begin to increase.

An increase in hydraulic pressure behind the downhole tool 116 may eventually force the down hole tool 116 through the downhole obstruction 122, thereby freeing it so that it may continue its trip to the target location. However, freeing the downhole tool 116 with elevated hydraulic pressure also places the full force of the pump at the surface 104 against the downhole tool 116 and its connection to the conveyance 120. If not properly mitigated, this hydraulic force could sever or "pump off" the downhole tool 116 from the conveyance 120 once the slack in the conveyance 120 is fully tightened. According to embodiments of the present disclosure, however, the downhole tool 116 may be configured or otherwise designed to avoid this problem by automatically relieving downward pressure on the downhole tool 116.

It will be appreciated by those skilled in the art that even though FIG. 1 depicts the downhole tool 116 as being arranged and operating in the horizontal portion 112 of the wellbore 106, the embodiments described herein are equally applicable for use in portions of the wellbore 106 that are vertical, deviated, or otherwise slanted. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead.

Figure 2:
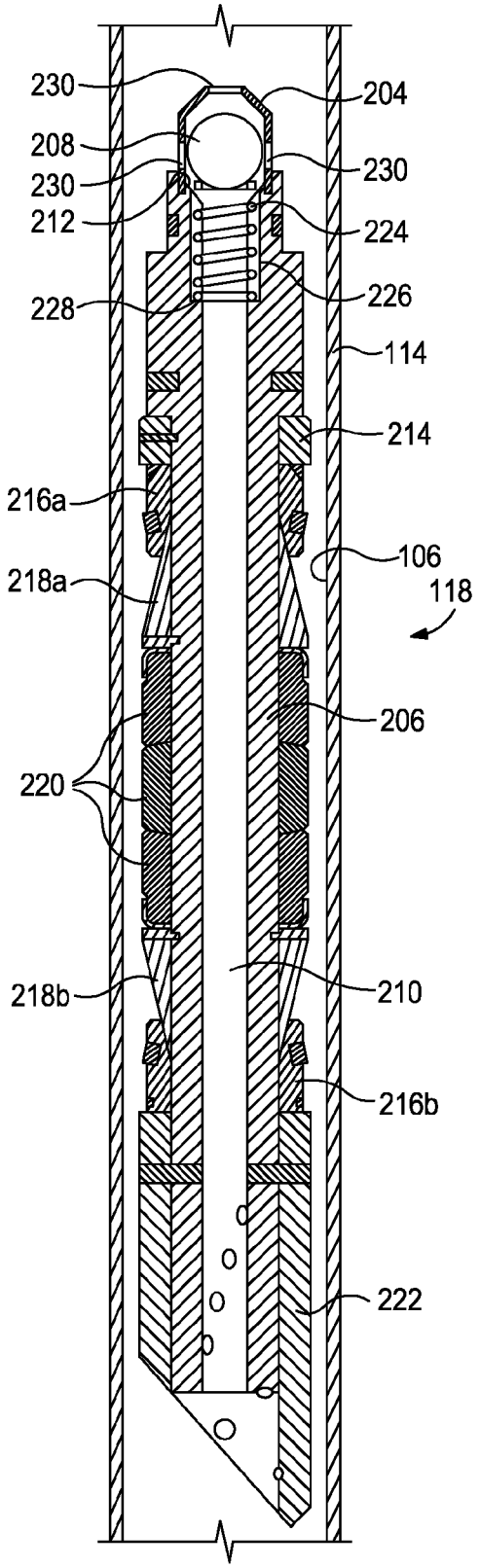
FIG. 2 illustrates an exemplary wellbore isolation device that may benefit from the principles of the present disclosure, according to one or more embodiments.

Referring now to FIG. 2, with continued reference to FIG. 1, illustrated is a cross-sectional view of an exemplary wellbore isolation device 118, according to one or more embodiments. The wellbore isolation device 118 is generally depicted and described herein as a frac plug but, as mentioned above, the wellbore isolation device 118 may be any other type of wellbore isolating device known and used in the art. Accordingly, the principles disclosed herein may equally apply to other types of wellbore isolation devices, such as bridge plugs or packers, without departing from the scope of the disclosure. In operation, the wellbore isolation device 118 (hereafter "the device 118") may be configured to seal a wellbore 106 to prevent flow past the device 118. In some embodiments, the wellbore 106 may be lined with casing 114 or another such annular structure or geometry in which the device 118 may suitably be set. In other embodiments, however, the casing 114 may be omitted and the device 118 may instead be set in an "open-hole" environment.

As illustrated, the device 118 may include a ball cage 204 extending from the upper end of a mandrel 206. A sealing ball 208 is disposed in the ball cage 204 and the mandrel 206 defines a longitudinal central flow passage 210. The mandrel 206 also defines a ball seat 212 at its upper end. One or more spacer rings 214 may be secured to the mandrel 206 and otherwise extend thereabout. The spacer ring 214 provides an abutment which axially retains upper slip segments 216*a* which are also positioned circumferentially about the mandrel 206. Lower slip segments 216*b* may be arranged distally from the upper slip segments 216*a*.

One or more slip wedges 218 (shown as upper and lower slip wedges 218*a* and 218*b*, respectively) may also be positioned circumferentially about the mandrel 206, and a packer assembly consisting of one or more expandable packer elements 220 may be disposed between the upper and lower slip wedges 218*a,b* and otherwise arranged about the mandrel 206. The particular packer assembly depicted in FIG. 2 is merely representative as there are several packer arrangements known and used within the art.

A mule shoe 222 is secured to the mandrel 206 at its lower or distal end. As will be appreciated, the lower most portion of the device 118 need not be a mule shoe 222, but could be any type of section that serves to terminate the structure of the device 118 or otherwise serves as a connector for connecting the device 118 on its downhole end to other tools, a valve, tubing, or other downhole equipment.

A spring 224 may be arranged within a chamber 226 defined in the mandrel 206 and otherwise coaxial with and fluidly coupled to the central flow passage 210. At one end, the spring 224 biases a shoulder 228 defined by the chamber 226 and at its opposing end the spring 224 engages and otherwise supports the sealing ball 208. The ball cage 204 may define a plurality of ports 230 (three shown) that allow the flow of fluids therethrough, thereby allowing fluids to flow through the length of the device 118 via the central flow passage 110.

In exemplary operation, as the device 118 is lowered into the wellbore 106 the spring 224 prevents the sealing ball 208 from engaging the ball seat 212. As a result, fluids may pass through the device 118; i.e., through the ports 230 and central flow passage 210. The ball cage 204 retains the sealing ball 208 such that it is not lost during translation into the wellbore 106 to its target location. Once the device 118 reaches the target location in the wellbore 106, a setting tool (not shown) of a type known in the art can be utilized to move the device 118 from its unset position (shown in FIG. 2) to a set position. In the set position, the slip segments 216 and the expandable packer elements 220 expand and engage the inner walls of the casing 114.

When it is desired to seal the wellbore 106 at the device 118, fluid is injected into the device 118 at a predetermined flow rate configured to overcome the spring force of the spring 224. The flow of fluid at the predetermined flow rate will force the sealing ball 208 against the spring 224, thereby overcoming its spring force and moving the sealing ball 208 downwardly until it engages the ball seat 212. When the sealing ball 208 is engaged with the ball seat 212 and the packing elements 220 are in their set position, fluid flow past or through the device 118 is effectively prevented. At that point, a slurry or other fluid may be displaced into the wellbore 106 and forced out into a formation above the device 118.

As discussed above, however, the device 118 (as part of the downhole tool 116) may encounter a downhole obstruction 122 (FIG. 1) while being conveyed to the target location within the wellbore 106, thereby stopping the progress of the device 118 and building up hydraulic pressure uphole from the downhole tool 116. Upon being freed from the downhole obstruction 122, unless the hydraulic pressure is mitigated, the downhole tool 116 and the device 118 may be pumped off or otherwise severed from the conveyance 120. In order to relieve built-up downward pressure caused by downhole obstruction 122 (FIG. 1), the downhole tool 116 may further include a tension-actuated valve and a pressure-actuated valve, as described below.

Figure 3A:
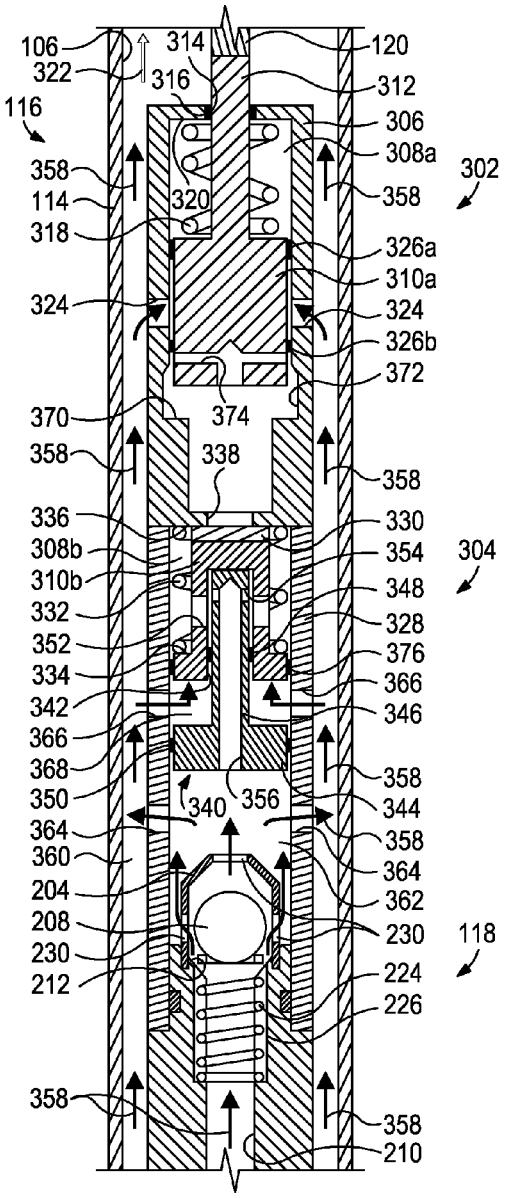
FIGS. 3A and 3B illustrate cross-sectional views of an exemplary downhole tool including a tension-actuated valve and a pressure-actuated valve, according to one or more embodiments.
Figure 3B:
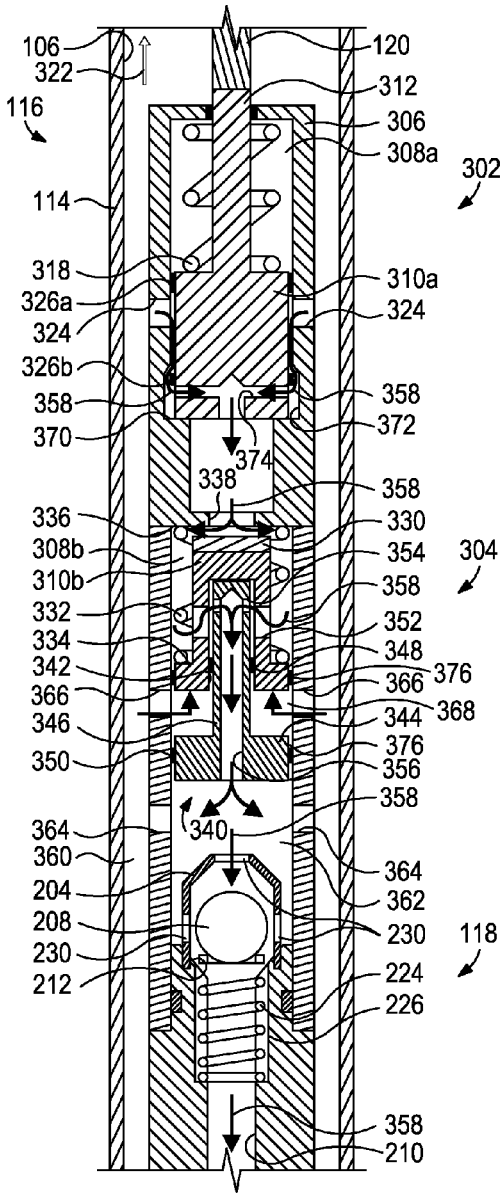

Referring now to FIGS. 3A and 3B, with continued reference to FIGS. 1 and 2, illustrated is a cross-sectional view of one embodiment of the downhole tool 116, including an exemplary tension-actuated valve 302 and an exemplary pressure-actuated valve 304, according to one or more embodiments. As illustrated, the downhole tool 116 may be extended within the wellbore 106 lined with casing 114 and may include the wellbore isolation device 118 (upper portion shown) described in FIG. 2. The pressure-actuated valve 304 may be coupled or otherwise attached to an uphole end of the device 118, and the tension-actuated valve 302 may be coupled or otherwise attached to an uphole end of the pressure-actuated valve 304.

The tension-actuated valve 302 may include a housing 306 defining a first piston chamber 308*a* that houses a first piston 310*a* therein. The first piston 310*a* may have a stem 312 that extends upwardly through an aperture 314 defined in the housing 306 and may be operatively coupled to the conveyance 120. One or more sealing elements 316, such as an O-ring or the like, may be arranged in the aperture 314 in order to seal the interface between the housing and the stem 312.

As used herein, the term "operatively coupled" refers to either a direct coupling engagement or a coupling engagement interposed by one or more structural elements. Accordingly, while the stem 312 is depicted in FIGS. 3A and 3B as being directly coupled to the conveyance 120, it is equally contemplated herein that the stem 312 may be coupled to one or more other structural elements (not shown) that interpose the stem 312 and the conveyance 120. In either case, axial tension in the conveyance 120 may be transferred to the first piston 310*a* via the stem 312 such that the first piston 310*a* is able to react thereto.

A biasing device 318, such as a compression spring or a series of Belleville washers, may be arranged in the first piston chamber 308*a* between the first piston 310*a* and an upper shoulder 320 of the housing 306. As illustrated, the aperture 314 may be defined in the upper shoulder 320. While the downhole tool 116 is conveyed into the wellbore 106, a tension 322 in the uphole direction may be applied on the conveyance 120 and transferred to the first piston 310*a* via the stem 312. The applied tension 322 may be generated through the overall weight of the tool string (including the downhole tool 116) as extended into the wellbore 106, and/or through hydraulic pressure acting on the downhole tool 116 as it is being pumped downhole.

In response to the applied tension 322, the first piston 310*a* may be forced in the uphole direction and compress the biasing device 318, thereby storing spring energy that will be released upon releasing the tension 322, as described below. The applied tension 322 may be configured to situate the first piston 310*a* within the first piston chamber 308*a* such that a first set of ports 324 (two shown) defined in the housing 306 are generally occluded or otherwise unable to convey fluids therethrough and into the first piston chamber 308*a*. More particularly, an upper sealing element 326*a* may be arranged between the first piston 310*a* and the housing 306 such that any fluids entering the first set of ports 324 are generally prevented from entering into the first piston chamber 308*a* above the first piston 310*a*. Likewise, a lower sealing element 326*b* may be arranged between the first piston 310*a* and the housing 306 such that fluids are generally prevented from entering into the first piston chamber 308*a* below the first piston 310*a*. The upper and lower sealing elements 326*a,b* may be any sealing device, such as O-rings or the like.

The pressure-actuated valve 304 may also include a housing 328 that defines a second piston chamber 308*b* having a second piston 310*b* movably arranged therein. The housing 328 may be coupled to the housing 306 of the tension-actuated valve 302 with a threaded engagement or one or more mechanical fasteners (not shown). At its distal end, the housing 328 may be coupled or otherwise attached to the device 118, such that the ball cage 204 extends a short distance into the housing 328. Accordingly, the downhole tool 116, including the tension-actuated valve 302, the pressure-actuated valve 304, and the device 118, may form a rigid, elongate portion of a wellbore tool string.

In some embodiments, however, the housings 306 and 328 of the tension-actuated valve 302 and the pressure-actuated valve 304, respectively, may encompass a single housing or otherwise be one and the same. In other words, the housing 306 may enclose both the tension-actuated valve 302 and the pressure-actuated valve 304 and may define both first and second piston chambers 308*a,b* and also house both the first and second pistons 310*a,b* therein.

A valve seat 330 may be arranged at an uphole end of the second piston 310*b* and otherwise coupled thereto. A biasing device 332, such as a compression spring or a series of Belleville washers, may be arranged within the second piston chamber 308*b* between a radial shoulder 334 of the second piston 310*a* and an upper shoulder 336 of the housing 328. An aperture 338 may be defined in the upper shoulder 336 in order to provide fluid communication between the first piston chamber 308*a* and the second piston chamber 308*b*.

The second piston 310*b* may further include a mandrel 340 longitudinally arranged within a bore 342 centrally defined within the second piston 310*b*. The mandrel 340 may have a base 344 and a generally cylindrical stem 346 that extends longitudinally from the base 344 and into the bore 342. One or more sealing elements 348, such as an O-ring or the like, may provide a fluid seal at the interface between the bore 342 and the stem 346. Likewise, one or more sealing elements 350, such as an O-ring or the like, may provide a fluid seal at the interface between the base 344 and the housing 328.

The second piston 310*b* may define one or more ports 352 that extend through the second piston 310*b* to the bore 342. The mandrel 340 may likewise define one or more ports 354 that may provide fluid communication into a bore 356 defined longitudinally within the stem 346 and extending through the base 344. Accordingly, the ports 352, 354 and the bore 356 may facilitate fluid communication through the second piston 310*b* and the mandrel 340 such that upper and lower portions of the second piston chamber 308*b* may fluidly communicate, as will be described in more detail below.

Referring additionally to FIG. 3B, in conjunction with FIG. 3A, exemplary operation of the downhole tool 116 is now provided and described. In particular, FIG. 3A depicts the downhole tool 116 in a running configuration, and FIG. 3B depicts the downhole tool 116 in a pressure-relieving configuration designed to prevent tool pump offs. As the downhole tool 116 is run (e.g., pumped) into the wellbore 106 in its running configuration (FIG. 3A), wellbore fluids 358 present in the wellbore 106 may flow past the device 118 in an annulus 360 defined between the downhole tool 116 and the inner walls of the wellbore 106 (i.e., the casing 114).

In the running configuration, the wellbore fluids 358 may also be able to pass through the central flow passage 210 of the device 118 and exit the device 118 via the ports 230 defined in the ball cage 204. Any fluids 358 exiting the device 118 via the ports 230 may enter a lower portion 362 of the second piston chamber 308*b* and subsequently exit the lower portion 362 into the annulus 360 via a second set of ports 364 defined in the housing 328.

The wellbore fluids 358 may also enter the second piston chamber 308*b* below the second piston 310*b* via a third set of ports 366 (two shown) defined in the housing 328. More particularly, the wellbore fluids 358 may enter an intermediate chamber 368 defined between the base 344 of the mandrel 340 and the bottom of the second piston 310*b* via the third set ports 366. Fluid pressure from the wellbore fluids 358 acts on the bottom of the second piston 310*b*, thereby forcing the second piston 310*b* upward within the second piston chamber 308*b*. As the second piston 310*b* is forced upward, it compresses the biasing device 332 and moves the valve seat 330 such that it generally occludes the aperture 338, thereby preventing fluid communication between the first and second piston chambers 308*a,b*. In at least one embodiment, the valve seat 330 may be made of a soft material, such as an elastomer, such that a fluid seal is generated at the interface between the upper shoulder 336 of the housing 328 and the valve seat 330.

As briefly mentioned above, while the downhole tool 116 is being run into the wellbore 106, tension 322 is applied on the conveyance 120 and is transferred to the first piston 310*a* such that the first piston 310*a* is situated to generally occlude the first set of ports 324. More particularly, in combination with the upper and lower sealing elements 326*a,b*, the first piston 310*a* may prevent the wellbore fluids 358 from entering into the first piston chamber 308*a* above or below the first piston 310*a*.

Upon encountering a downhole obstruction 122 (FIG. 1), however, the progress of the downhole tool 116 within the wellbore 106 may stop. As a result, the tension 322 applied on the conveyance 120 in the uphole direction is reduced and the fluid pressure within the wellbore 106 above the downhole tool 116 begins to increase. A decrease in the tension 322 applied on the conveyance 120 allows the stored spring force of the biasing device 318 to move the first piston 310*a* axially downward within the first piston chamber 308*a* until engaging a radial shoulder 370 defined in a lower portion of the first piston chamber 308*a*.

Moving the first piston 310*a* downward correspondingly moves the lower sealing element 326*b* out of engagement with the housing 306 and instead into a groove 372 also defined in the lower portion of the first piston chamber 308*a*. This configuration is shown in FIG. 3B. With the lower sealing element 326*b* out of engagement with the housing 306, any wellbore fluids 358 passing through the first set of ports 324 may bypass the lower sealing element 326*b* and enter the first piston chamber 308*a* via one or more conduits 374 defined through the first piston 310*a*. As illustrated, the conduit(s) 374 may fluidly communicate with the lower portion of the first piston chamber 308*a*.

With the tension-actuated valve 302 in its pressure-relieving position (FIG. 3B), increasing fluid pressure of the wellbore fluids 358 may act on the valve seat 330 via the first piston chamber 308*a*. However, increasing fluid pressure of the wellbore fluids 358 may equally act on the lower end of the second piston 310*b* via the third set of ports 366. As a result, the second piston 310*b* remains stationary.

Once the downhole obstruction 122 (FIG. 1) is cleared, however, the downhole tool 116 may experience a large pressure drop as the built up pressure behind the downhole tool 116 accelerates and propels the downhole tool 116 down the wellbore 106. Such a drop in fluid pressure allows the biasing device 332 in the second piston chamber 308*b* to move the second piston 310*b* downward to its pressure-relieving position (FIG. 3B). In the pressure-relieving position, the second piston 310*b* (e.g., the valve seat 330) is removed from engagement with the upper shoulder 336 of the housing 328, thereby opening the aperture 338 to fluid communication between the first piston chamber 308*a* and the second piston chamber 308*b* via the aperture 338. One or more sealing elements 376, such as an O-ring or the like, may be arranged between the second piston chamber 308*b* and the second piston 310*b* in order to provide a fluid seal at the interface therebetween.

Referring specifically to FIG. 3B, with the aperture 338 exposed, the wellbore fluids 358 may freely flow into the second piston chamber 308*b* from the first piston chamber 308*a*. The wellbore fluids 358 entering the second piston chamber 308*b* may flow through the ports 352 and 354 defined in the second piston 310*b* and the mandrel 340, respectively, and subsequently through the bore 356 of the mandrel 340 until reaching the lower portion 362 of the second piston chamber 308*b* below the mandrel 340. Such fluids 358 may be able to exit the lower portion 362 into the annulus 360 via the second set of ports 364 defined in the housing 328 or otherwise pass through the device 118 via the ports 230 and the central flow passage 210.

After being propelled through the wellbore 106 following clearance of the downhole obstruction 122 (FIG. 1), the tension 322 in the conveyance 120 will increase dramatically once the slack thereof is removed and otherwise reaches its end. However, since the tension-actuated valve 302 and the pressure-actuated valve 304 allow wellbore fluids 358 to flow through the downhole tool 116 upon experiencing the pressure drop related to the clearance of the downhole obstruction 122 (FIG. 1), the resulting downward force transmitted to the downhole tool 116 will be reduced and otherwise minimized. More particularly, allowing fluid flow through the downhole tool 116 upon experiencing the pressure drop may reduce hydraulic forces acting on the downhole tool 116 and thereby minimize the sudden increase in tension 322 endured by the downhole tool 116 once the slack in the conveyance 120 is spent. As a result, the downhole tool 116 may be less likely to be pumped off or severed from the conveyance 120.

Once tension 322 is restored to the conveyance 120, the first piston 310*a* will again compress the biasing device 318 and move the lower sealing element 326*b* back into engagement with the housing 306 and otherwise effectively occlude the first set of ports 324 such that wellbore fluids 358 are once again prevented from entering the first piston chamber 308*a*.

Likewise, as the pressure within the wellbore 106 begins to increase again, the wellbore fluids 358 entering the second piston chamber 308*b* (i.e., the intermediate chamber 368) via the third set of ports 366 may act on the second piston 310*b*. As the hydraulic pressure builds, the second piston 310*b* compresses the biasing device 332 until engaging the upper shoulder 336 and again effectively occluding the aperture 338. With the aperture 338 occluded by the second piston 310*b* (i.e., the valve seat 330), fluid communication is once again prevented between the first and second piston chambers 308*a,b* and the downhole tool 116 is returned to its running configuration.

Embodiments disclosed herein include:

A. A downhole tool that includes a housing coupled to a wellbore isolation device, a tension-actuated valve arranged within the housing and having a first piston movably arranged within a first piston chamber, the first piston being operatively coupled to a conveyance such that tension in the conveyance is transmitted to the first piston, wherein, when the tension in the conveyance is reduced, the first piston is moved within the first piston chamber such that wellbore fluids are able to enter the first piston chamber, and a pressure-actuated valve arranged within the housing and having a second piston movably arranged within a second piston chamber in order to place the second piston chamber in fluid communication with the first piston chamber. Upon experiencing a pressure drop across the downhole tool, the second piston is moved within the second piston chamber such that the wellbore fluids are able to pass into the second piston chamber and through the wellbore isolation device, thereby reducing hydraulic forces on the downhole tool when the tension in the conveyance is restored.

B. A method that includes pumping a downhole tool into a wellbore, the downhole tool being coupled to a conveyance and including a housing coupled to a wellbore isolation device, a tension-actuated valve arranged within the housing and having a first piston movably arranged within a first piston chamber and being operatively coupled to the conveyance such that tension in the conveyance is transmitted to the first piston, and a pressure-actuated valve arranged within the housing and having a second piston movably arranged within a second piston chamber in order to place the second piston chamber in fluid communication with the first piston chamber. The method may also include moving the first piston within the first piston chamber when the tension in the conveyance is reduced, and thereby allowing wellbore fluids to enter the first piston chamber, moving the second piston within the second piston chamber upon experiencing a pressure drop across the downhole tool, and thereby allowing the wellbore fluids to pass into the second piston chamber, and conveying at least a portion of the wellbore fluids through the wellbore isolation device from the second piston chamber and thereby reducing hydraulic forces on the downhole tool when the tension in the conveyance is restored.

Each of embodiments A and B may have one or more of the following additional elements in any combination: Element 1: wherein the tension in the conveyance is reduced when the downhole tool encounters a downhole obstruction within a wellbore. Element 2: wherein the pressure drop occurs when the downhole tool clears the downhole obstruction and hydraulic pressure built up in the wellbore propels the downhole tool down the wellbore. Element 3: further comprising a mandrel arranged within a bore centrally defined within the second piston and having a stem that extends from a base and a mandrel bore defined within the stem, a first set of ports defined in the second piston and extending into the bore of the second piston, and a second set of ports defined in the stem and extending into the mandrel bore, wherein the first and second sets of ports and the mandrel facilitate fluid communication through the second piston and the mandrel such that the wellbore fluids are able to flow through the second piston and to the wellbore isolation device. Element 4: further comprising a biasing device arranged within the first piston chamber and being configured to move the first piston when the tension in the conveyance is reduced. Element 5: wherein, when the biasing device moves the first piston, the wellbore fluids are able to enter the first piston chamber by passing through a first set of ports defined in the housing and bypassing at least one sealing element that has moved into a groove defined in the first piston chamber. Element 6: further comprising one or more conduits defined through the first piston and configured to convey the wellbore fluids into the first piston chamber after bypassing the at least one sealing element. Element 7: further comprising a biasing device arranged within the second piston chamber and being configured to move the second piston when pressure drop across the downhole tool occurs. Element 8: wherein the second piston occludes an aperture defined in the housing until being moved as a result of the pressure drop, the aperture providing a conduit that fluidly communicates that first and second chambers.

Element 9: further comprising reducing the tension in the conveyance by encountering a downhole obstruction within the wellbore. Element 10: further comprising generating the pressure drop across the downhole tool by clearing the downhole obstruction and propelling the downhole tool within the wellbore using built up hydraulic pressure. Element 11: wherein moving the first piston within the first piston chamber comprises moving the first piston with a biasing device arranged within the first piston chamber. Element 12: further comprising moving at least one sealing element arranged about the first piston into a groove defined in the first piston chamber when the biasing device moves the first piston, and conveying the wellbore fluids through a first set of ports defined in the housing and around the at least one sealing element that has moved into the groove. Element 13: further comprising conveying the wellbore fluids into the first piston chamber via one or more conduits defined through the first piston after bypassing the at least one sealing element. Element 14: further comprising moving the second piston with a biasing device arranged within the second piston chamber when the pressure drop occurs across the downhole tool. Element 15: further comprising occluding an aperture defined in the housing with the second piston until the second piston is moved by the biasing device, the aperture providing a conduit that fluidly communicates the first and second piston chambers. Element 16: wherein conveying the portion of the wellbore fluids through the wellbore isolation device from the second piston chamber further comprises conveying the wellbore fluids through a first set of ports defined in the second piston and extending into a bore centrally defined within the second piston, conveying the wellbore fluids through a second set of ports defined in a mandrel arranged within the bore and having a stem that extends from a base and a mandrel bore defined within the stem, and conveying the wellbore fluids through the mandrel bore to the wellbore isolation device.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A downhole tool, comprising:

a housing coupled to a wellbore isolation device;

a tension-actuated valve arranged within the housing and having a first piston movably arranged within a first piston chamber, the first piston being operatively coupled to a conveyance such that tension in the conveyance is transmitted to the first piston, wherein, when the tension in the conveyance is reduced, the first piston is moved within the first piston chamber such that wellbore fluids are able to enter the first piston chamber; and a pressure-actuated valve arranged within the housing and having a second piston movably arranged within a second piston chamber in order to place the second piston chamber in fluid communication with the first piston chamber, wherein, upon experiencing a pressure drop across the downhole tool, the second piston is moved within the second piston chamber such that the wellbore fluids are able to pass into the second piston chamber and through the wellbore isolation device, thereby reducing hydraulic forces on the downhole tool when the tension in the conveyance is restored.

2. The downhole tool of claim 1, wherein the tension in the conveyance is reduced when the downhole tool encounters a downhole obstruction within a wellbore.

3. The downhole tool of claim 2, wherein the pressure drop occurs when the downhole tool clears the downhole obstruction and hydraulic pressure built up in the wellbore propels the downhole tool down the wellbore.

4. The downhole tool of claim 1, further comprising:

a mandrel arranged within a bore centrally defined within the second piston and having a stem that extends from a base and a mandrel bore defined within the stem;

a first set of ports defined in the second piston and extending into the bore of the second piston; and a second set of ports defined in the stem and extending into the mandrel bore, wherein the first and second sets of ports and the mandrel facilitate fluid communication through the second piston and the mandrel such that the wellbore fluids are able to flow through the second piston and to the wellbore isolation device.

5. The downhole tool of claim 1, further comprising a biasing device arranged within the first piston chamber and being configured to move the first piston when the tension in the conveyance is reduced.

6. The downhole tool of claim 5, wherein, when the biasing device moves the first piston, the wellbore fluids are able to enter the first piston chamber by passing through a first set of ports defined in the housing and bypassing at least one sealing element that has moved into a groove defined in the first piston chamber.

7. The downhole tool of claim 6, further comprising one or more conduits defined through the first piston and configured to convey the wellbore fluids into the first piston chamber after bypassing the at least one sealing element.

8. The downhole tool of claim 1, further comprising a biasing device arranged within the second piston chamber and being configured to move the second piston when pressure drop across the downhole tool occurs.

9. The downhole tool of claim 8, wherein the second piston occludes an aperture defined in the housing until being moved as a result of the pressure drop, the aperture providing a conduit that fluidly communicates that first and second chambers.

10. The downhole tool of claim 9, wherein the second piston further comprises a valve seat that occludes the aperture until the biasing device moves the second piston.

11. A method, comprising:

pumping a downhole tool into a wellbore, the downhole tool being coupled to a conveyance and comprising:

a housing coupled to a wellbore isolation device;

a tension-actuated valve arranged within the housing and having a first piston movably arranged within a first piston chamber and being operatively coupled to the conveyance such that tension in the conveyance is transmitted to the first piston; and a pressure-actuated valve arranged within the housing and having a second piston movably arranged within a second piston chamber in order to place the second piston chamber in fluid communication with the first piston chamber;

moving the first piston within the first piston chamber when the tension in the conveyance is reduced, and thereby allowing wellbore fluids to enter the first piston chamber;

moving the second piston within the second piston chamber upon experiencing a pressure drop across the downhole tool, and thereby allowing the wellbore fluids to pass into the second piston chamber; and conveying at least a portion of the wellbore fluids through the wellbore isolation device from the second piston chamber and thereby reducing hydraulic forces on the downhole tool when the tension in the conveyance is restored.

12. The method of claim 11, further comprising reducing the tension in the conveyance by encountering a downhole obstruction within the wellbore.

13. The method of claim 12, further comprising generating the pressure drop across the downhole tool by clearing the downhole obstruction and propelling the downhole tool within the wellbore using built up hydraulic pressure.

14. The method of claim 11, wherein moving the first piston within the first piston chamber comprises moving the first piston with a biasing device arranged within the first piston chamber.

15. The method of claim 14, further comprising:

moving at least one sealing element arranged about the first piston into a groove defined in the first piston chamber when the biasing device moves the first piston; and conveying the wellbore fluids through a first set of ports defined in the housing and around the at least one sealing element that has moved into the groove.

16. The method of claim 15, further comprising conveying the wellbore fluids into the first piston chamber via one or more conduits defined through the first piston after bypassing the at least one sealing element.

17. The method of claim 11, further comprising moving the second piston with a biasing device arranged within the second piston chamber when the pressure drop occurs across the downhole tool.

18. The method of claim 17, further comprising occluding an aperture defined in the housing with the second piston until the second piston is moved by the biasing device, the aperture providing a conduit that fluidly communicates the first and second piston chambers.

19. The method of claim 11, wherein conveying the portion of the wellbore fluids through the wellbore isolation device from the second piston chamber further comprises:

conveying the wellbore fluids through a first set of ports defined in the second piston and extending into a bore centrally defined within the second piston;

conveying the wellbore fluids through a second set of ports defined in a mandrel arranged within the bore and having a stem that extends from a base and a mandrel bore defined within the stem; and conveying the wellbore fluids through the mandrel bore to the wellbore isolation device.

* * * * *